US005153940A

United States Patent [19]

Bergquist

[11] Patent Number: 5,153,940

[45] Date of Patent: Oct. 13, 1992

[54] CHILDREN'S GARMENT

[76] Inventor: Mary T. Bergquist, 3 Quaker Dr., Schenectady, N.Y. 12309

[21] Appl. No.: 824,937

[22] Filed: Jan. 24, 1992

[51] Int. Cl.[5] ..... A41D 11/00

[52] U.S. Cl. ..... 2/80; 2/46; 2/49 R; 2/83; 2/114; 2/122; 2/DIG. 7; 2/75

[58] Field of Search ..... 2/80, 83, 46, 49 R, 2/114, 121, 122, 174, DIG. 7, 75, 48

[56] References Cited

U.S. PATENT DOCUMENTS

| | | | |
|---|---|---|---|
| 1,548,830 | 8/1925 | Dunsworth | 2/48 |
| 2,425,635 | 8/1947 | Nitzberg | 2/75 |
| 2,469,556 | 5/1949 | Jacobson | 2/83 |
| 2,568,544 | 9/1951 | Head | 2/46 |
| 2,635,245 | 4/1953 | Nigro | 2/80 |
| 2,649,589 | 8/1953 | Shiltong | 2/75 |
| 2,814,044 | 11/1957 | Tucker | 2/80 |
| 2,922,164 | 1/1960 | Liff | 2/49 |
| 3,174,156 | 3/1965 | Dale et al. | 2/49 |
| 3,608,092 | 9/1971 | Taranto | 2/49 R |
| 3,616,464 | 11/1971 | Whitten | 2/48 |
| 3,984,876 | 10/1976 | Sutton | 2/48 |
| 4,304,006 | 12/1981 | Swart | 2/49 R |
| 4,712,251 | 12/1987 | Cobble | 2/49 R |
| 4,754,500 | 7/1988 | Brucato et al. | 2/114 |
| 4,843,648 | 7/1989 | Goldberg | 2/80 |
| 4,860,387 | 8/1989 | Williams | 2/244 |
| 4,884,298 | 12/1989 | Silas | 2/49 R |

FOREIGN PATENT DOCUMENTS

| | | | |
|---|---|---|---|
| 1083235 | 9/1967 | United Kingdom | 2/80 |

*Primary Examiner*—Werner H. Schroeder
*Assistant Examiner*—Gloria Hale
*Attorney, Agent, or Firm*—R. Neil Sudol; Henry D. Coleman

[57] ABSTRACT

A children's garment comprises a garment body in the form of a sleeper including a chest portion, integral soft shoes and a zipper member extending from a collar of the sleeper to one of the shoes. A moisture absorbent layer with a moisture impervious film coating on an underside overlies at least part of the chest portion. The absorbent layer is substantially coextensive with the impervious film and has a periphery attached to the garment body so that the impervious film and the absorbent layer are essentially permanently integral with the garment body. The zipper member divides each of the chest portion, the moisture impervious film and the absorbent layer into two sections.

11 Claims, 2 Drawing Sheets

CHILDREN'S GARMENT

BACKGROUND OF THE INVENTION

This invention relates to a children's garment. More particularly, this invention relates to a children's garment which includes an attached bib.

The purpose and the function of bibs are well known. Bibs protect children's clothing from saliva which dribbles incessantly from infants' mouths. Bibs are particularly useful in shielding clothing from baby food during the feeding process.

Generally, bibs are separate napkin-like accessories which are provided with tie strings for releasably attaching the bibs around infants' necks. However, children's garments are known wherein the bib is integrally attached to the main body of the garment. For example, Head U.S. Pat. No. 2,568,544 discloses a shirt with a superposed ply overlying the breast portion of the shirt and stitched thereto along the bottom and side edges of the ply. The ply thus forms a pocket for receiving a flat sheet of flexible water-proof plastic.

Taranto U.S. Pat. No. 3,608,092 similarly discloses a bib portion in the form of multiple foam layers attached to a shirt in the chest region thereof.

OBJECTS OF THE INVENTION

An object of the present invention is to provide a children's garment with an attached bib.

Another object of the present invention is to provide such a children's garment which is particularly useful and convenient.

Another, more particular, object of the present invention is to provide such a garment which provides convenient protection during evening and morning feeding periods.

A further particular object of the present invention is to provide such a garment which is easy to clean.

Yet another particular object of the present invention is to provide such a garment which is inexpensive to manufacture.

SUMMARY OF THE INVENTION

A children's garment comprises, in accordance with the present invention, a garment body including a chest portion, a moisture impervious layer overlying at least part of the chest portion, and a moisture absorbent layer overlying the impervious layer. The absorbent layer is substantially coextensive with the impervious layer and has a periphery attached to the garment body so that the impervious layer and the absorbent layer are essentially permanently integral with the garment body. A zipper member is attached to the garment body and divides each of the chest portion, the impervious layer and the absorbent layer into two sections, the absorbent layer being attached to the chest portion along opposite sides of the zipper member.

Preferably, the garment body takes the form of a sleeper, preferably made of a soft nonwoven material and preferably having integral soft shoe or sock portions.

Pursuant to another feature of the present invention, the moisture impervious layer and the absorbent layer have edge portions which overlap the zipper member and thus effectively shield that element from food and saliva.

Pursuant to an alternative conceptualization of the present invention, a children's garment comprises a garment body including a chest portion divided into two sections, a zipper member attached to each of the sections to releasably fasten them to one another, and a pair of bib members each overlying and permanently attached to a respective one of the chest sections to effectively cover the chest portion of the sleeper. Each of the bib members is fastened along its periphery to the respective sleeper chest section and includes a moisture impervious layer and a moisture absorbent layer. Each moisture impervious layer is disposed between the respective sleeper chest section and the respective absorbent layer. The bib members have edge portions overlapping the zipper member to provide a shield therefor.

Pursuant to a preferred embodiment of the present invention, the garment body takes the form of a sleeper and the zipper member extends from a neck region of the sleeper to a foot region thereof.

Pursuant to another feature of the present invention, the bib members are fastened by sewn seams or stitches to the sleeper chest sections.

A children's garment in accordance with the present invention is particularly useful and convenient. The zipper closure element facilitates the disposition and removal of the garment. Where the garment takes the specific form of a sleeper (made of a soft nonwoven material, having integral shoe or sock portions), the garment is especially convenient in providing an infant with a bib which remains in place despite the infant's motions during the night and which is in place for evening and morning feeding periods.

The attached bib means that the bib and the attached garment, e.g., sleeper, are easy to clean.

DETAILED DESCRIPTION

Figure 1:
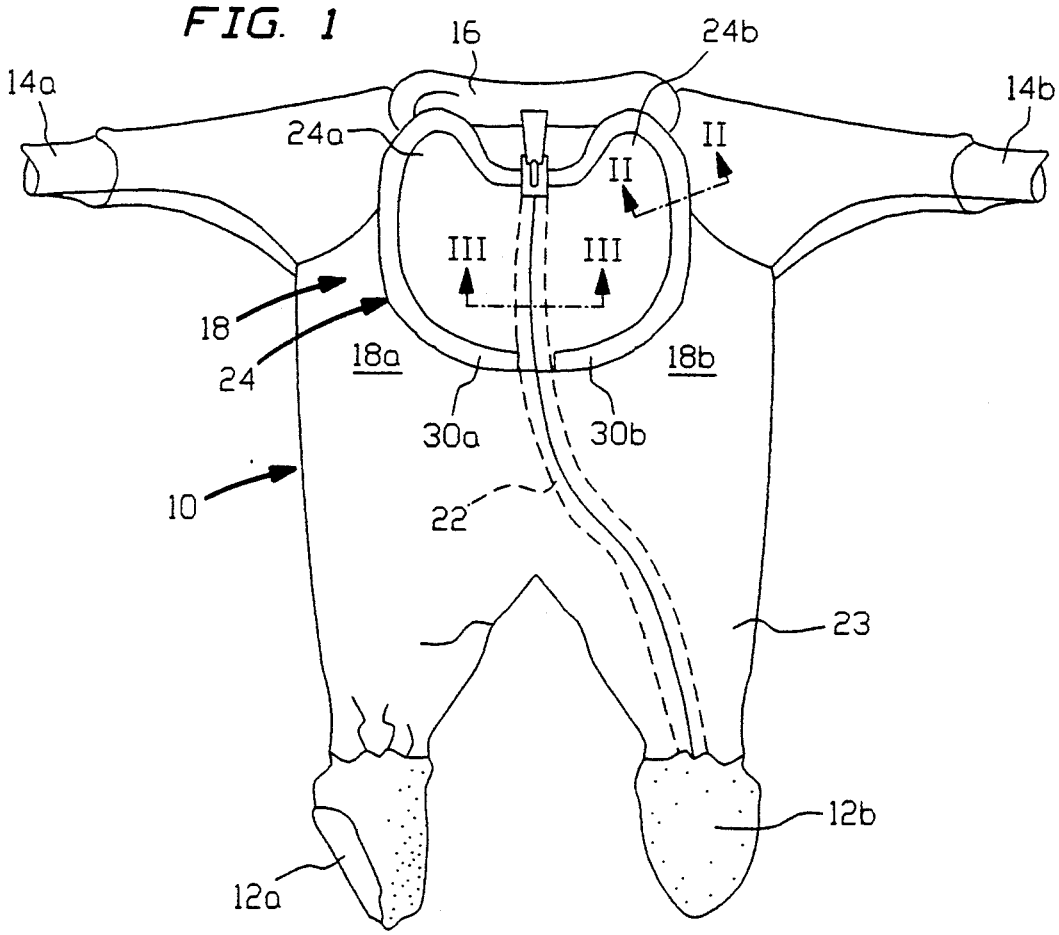
FIG. 1 is a front elevational view of a children's garment in accordance with the present invention.
Figure 2:
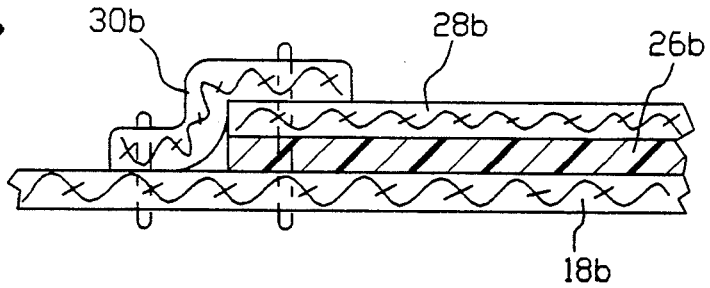
FIG. 2 is a partial cross-sectional view, on an enlarged scale, taken along line II—II in FIG. 1.

As illustrated in FIG. 1, a children's garment includes a body 10 in the form of a sleeper. Sleeper 10 is made of a soft nonwoven material and has integral nonwoven shoe or sock portions 12*a* and 12*b*, knitted sleeve ends 14*a* and 14*b*, and a knitted collar 16. Sleeper 10 includes a chest portion 18 divided into two sections 18*a* and 18*b* by a zipper member 22 which extends from collar 16 down one leg 23 to shoe 12*b*.

Figure 3:
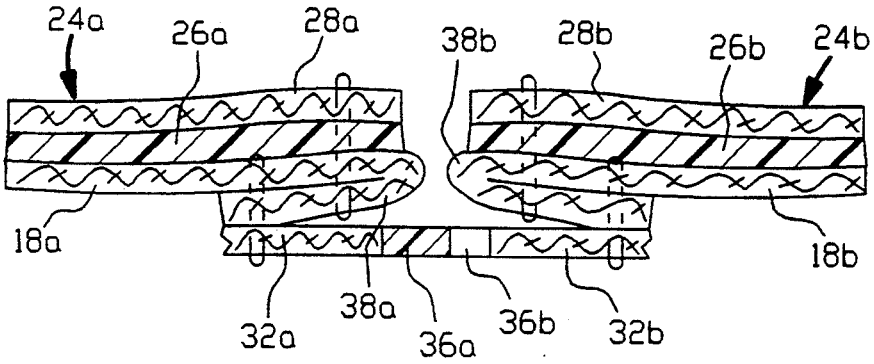
FIG. 3 is a partial cross-sectional view, also on an enlarged scale, taken along line III—III in FIG. 1.

Attached to chest portion 18 is a bib 24 including two sections 24*a* and 24*b* which overlie respective chest sections 18*a* and 18*b*. As illustrated in FIG. 3, each bib section 24*a* and 24*b* comprises a moisture impervious or resistant layer 26*a* and 26*b* overlying at least part of the respective chest section 18*a* and 18*b*, and a moisture absorbent layer 28*a* and 28*b* overlying the respective impervious layer 26*a* and 26*b*. Preferably, moisture impervious layers 26*a* and 26*b* take the form of films or coatings applied to the backsides of absorbent layers 28*a* and 28*b*. Accordingly, absorbent layers 28*a* and 28*b* are substantially coextensive with respective impervious layers 26*a* and 26*b*. Absorbent layers 28*a* and 28*b* may be made of a material like terry cloth.

Bib sections 24*a* and 24*b* are stitched along their perimeters to chest sections 18*a* and 18*b* of sleeper 10 so that moisture impervious layers 26 *a* and 26 *b* and absorbent layers 28*a* and 28*b* are essentially permanently integral with chest portion 18. Piping or edging strips 30*a* and 30*b*, serving reinforcement and decorative purposes, are stitched to chest portions 18*a* and 18*b*, through bib sections 24*a* and 24*b*, respectively.

As depicted in FIG. 3, zipper member 22 comprises a pair of woven strips 32*a* and 32*b* sewn to chest portions 18*a* and 18*b*, respectively. Zipper strips 32*a* and 32*b* carry intermeshing zipper teeth 34*a* and 34*b*. Bib sections 24*a* and 24*b* have edge portions 36*a* and 36*b* extending alongside zipper member 22. Edge portions 36*a* and 36*b*, together with a folded lips 38*a* and 38*b* of chest portions 18*a* and 18*b*, overlap zipper strips 32*a* and 32*b* so as to effectively shield zipper member 22 from food, such as milk from bottle or breast, and an infant wearer's oral excretions.

Zipper member 22 is attached to sleeper 10 and divides chest portion 24, an impervious layer formed of layers 26 *a* and 26*b*, and an absorbent layer composed of layers 28*a* and 28*b* into two sections each.

Figure 4:
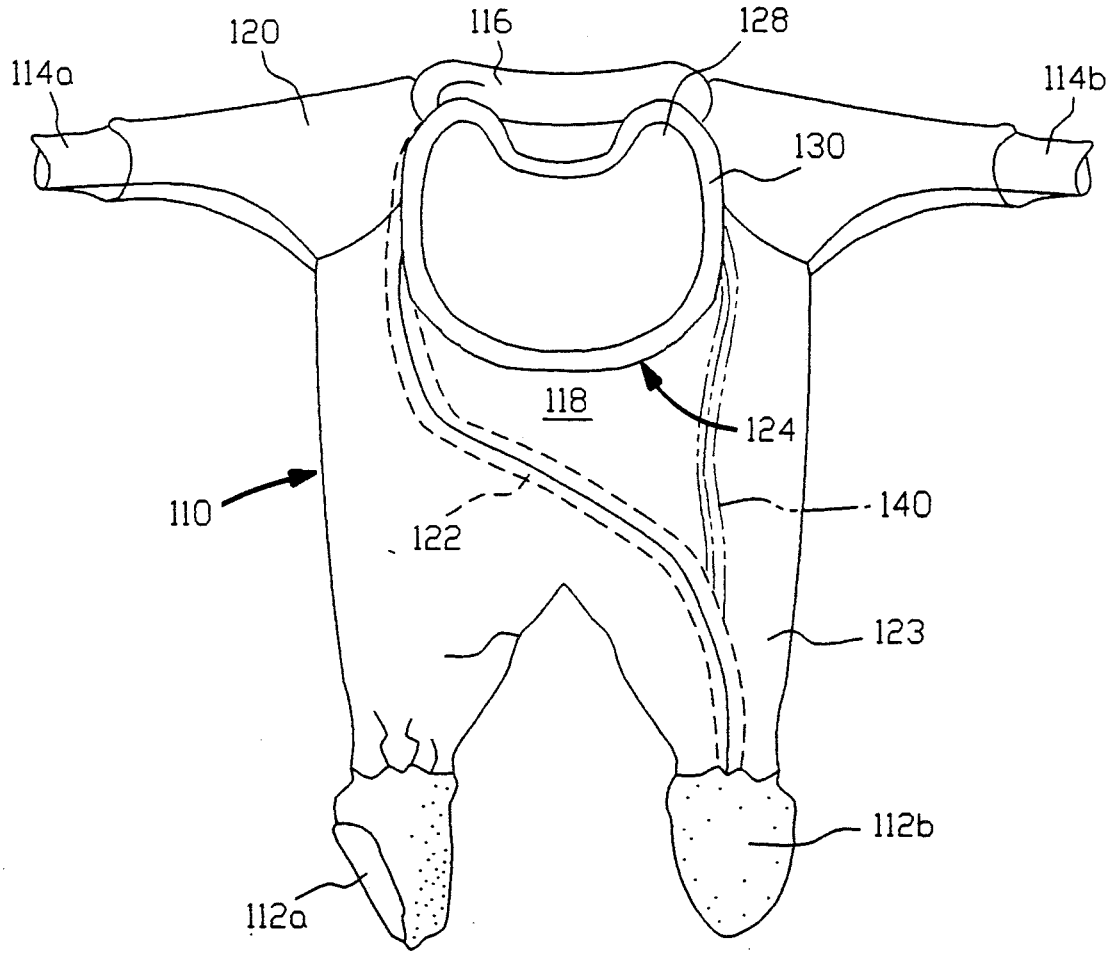
FIG. 4 is a front elevational view of a modified children's garment in accordance with the present invention.

As illustrated in FIG. 4, another children's garment includes a body 110 in the form of a sleeper. Sleeper 110 is made of a soft nonwoven material and has integral nonwoven shoe or sock portions 112*a* and 112*b*, knitted sleeve ends 114*a* and 114*b*, and a knitted collar 116. Sleeper 110 includes a chest portion 118 which is divided or separated from a sleeve 120 by a zipper member 122 which extends from collar 116 down one leg 123 to shoe 112*b*.

Attached to chest portion 118 is a bib 124. As described hereinabove with reference to bib 24, bib 124 comprises a moisture impervious or resistant layer (not shown) overlying at least part of chest portion 118 and a moisture absorbent layer 128 overlying the respective impervious layer. Preferably, the moisture impervious layer takes the form of a film or coating applied to the backside of the absorbent layer. Accordingly, the absorbent layer is substantially coextensive with the moisture impervious layer. The absorbent layer may be made of a material like terry cloth.

Bib 124 is stitched along its perimeter to chest portion 118 so that the moisture impervious layer and absorbent layer 128 are essentially permanently integral with chest portion 118. A piping or edging strip 130, serving reinforcement and decorative purposes, is stitched to chest portion 118 through bib 124.

Zipper member 122 is overlapped by a edge portion 136 of moisture absorbent layer 128.

Although the invention has been described in terms of particular embodiments and applications, one of ordinary skill in the art, in light of this teaching, can generate additional embodiments and modifications without departing from the spirit of or exceeding the scope of the claimed invention. For example, zipper member 122 may extend up the same side of sleeper 110, as indicated at 140. Accordingly, it is to be understood that the drawings and descriptions herein are proferred by way of example to facilitate comprehension of the invention and should not be construed to limit the scope thereof.

What is claimed is:

1. A children's garment comprising:

a garment body including a chest portion;

a moisture impervious layer overlying at least part of said chest portion;

a moisture absorbent layer overlying said impervious layer, said absorbent layer being substantially coextensive with said impervious layer, said absorbent layer having a periphery attached to said garment body so that said impervious layer and said absorbent layer are essentially permanently integral with said garment body; and a zipper member attached to said garment body and dividing each of said chest portion, said impervious layer and said absorbent layer into two sections, said absorbent layer being attached to said chest portion along opposite sides of said zipper member.

2. The garment defined in claim 1 wherein said garment body takes the form of a sleeper.

3. The garment defined in claim 1 wherein said two sections each has an edge portion overlapping said zipper member.

4. A children's garment comprising:

a garment body including a chest portion;

a bib permanently attached to said chest portion, said bib including a moisture impervious layer and a moisture absorbent layer, said impervious layer being disposed between said chest portion and said absorbent layer; and a zipper member attached to said garment body and dividing each of said chest portion, said impervious layer and said absorbent layer into two sections, said absorbent layer being attached to said chest portion along opposite sides of said zipper member.

5. The garment defined in claim 4 wherein said garment body takes the form of a sleeper.

6. The garment defined in claim 4 wherein said two sections each has an edge portion overlapping said zipper member.

7. A children's garment comprising:

a garment body including a chest portion divided into two sections;

a zipper member attached to each of said sections to releasably fasten same to one another; and a pair of bib members each overlying and permanently attached to one of said sections to effectively cover said chest portion, each of said bib members being fastened along its periphery to the respective one of said sections, each of said bib members including a moisture impervious layer and a moisture absorbent layer, said impervious layer being disposed between the respective section of said chest portion and the respective absorbent layer, said bib members having edge portions overlapping said zipper member to provide a shield therefor.

8. The garment defined in claim 7 wherein said garment body takes the form of a sleeper and said zipper member extends from a neck region of said sleeper to a foot region thereof.

9. The garment defined in claim 7 wherein said bib members are fastened by sewn seams to said sections.

10. A children's garment comprising:

a garment body including a chest portion and a pair of integral leg portions;

a moisture impervious layer overlying at least part of said chest portion;

a moisture absorbent layer overlying said impervious layer, said absorbent layer being substantially coextensive with said impervious layer, said absorbent layer having a periphery attached to said garment body so that said impervious layer and said absorbent layer are essentially permanently integral with said garment body; and a zipper member attached to said garment body and extending from one of said leg portions alongside said moisture impervious layer and said moisture absorbent layer to a collar of said garment body.

11. The garment defined in claim 10 wherein said zipper member is overlapped by a portion of said moisture absorbent layer.

* * * * *